United States Patent [19]

Partes

[11] 4,163,322

[45] Aug. 7, 1979

[54] COMPASS WITH FINE ADJUSTMENT

[75] Inventor: Günther Partes, Brunn, Fed. Rep. of Germany

[73] Assignee: Intertech Zeichengeräte Günther Partes KG, Fed. Rep. of Germany

[21] Appl. No.: 875,409

[22] Filed: Feb. 6, 1978

[30] Foreign Application Priority Data

Feb. 5, 1977 [DE] Fed. Rep. of Germany ..... 2704864

[51] Int. Cl.[2] ..... B43L 9/22

[52] U.S. Cl. ..... 33/27 B; 33/191; 33/154 R

[58] Field of Search ..... 33/27 B, 148, 149, 150, 33/151, 152, 153, 154, 155, 156, 157, 191

[56] References Cited

U.S. PATENT DOCUMENTS

| | | | |
|---|---|---|---|
| 1,396,417 | 11/1921 | Gepack | 33/191 |
| 2,074,102 | 3/1937 | Christy | 33/27 B |
| 2,568,559 | 9/1951 | Nolde | 33/154 R |
| 3,137,947 | 6/1964 | Flower | 33/191 |

*Primary Examiner*—Richard E. Aegerter
*Assistant Examiner*—John W. Shepperd
*Attorney, Agent, or Firm*—Holman & Stern

[57] ABSTRACT

A compass is provided which includes a fine adjustment mechanism comprising lateral spreader bars attached to the respective compass legs and a central drive wheel meshing with the spreader bars. The spreader bars and drive wheel are located in a compass head consisting of front and rear half shells which have lateral guides for the spreader bars and a rotary disc for operating the drive wheel.

4 Claims, 4 Drawing Figures

COMPASS WITH FINE ADJUSTMENT

The invention relates to a compass with fine adjustment, actuated by means of a centrally located drive wheel between the compass legs, reacting upon at least two spreaders arranged parallel to each other and extending in the compass plane, one connected with one compass leg and the other with the other compass leg, and between which the meshing-contact drive-wheel is arranged with its shaft perpendicular to the compass plane.

A compass of this type is known from U.S. Pat. No. 1,396,417. In this known compass back leg has a bow-shaped toothed segment integral with the leg and located on the inside of the leg approximately in the middle; between the two toothed segments vertically at a distance from each other, a third and meshing drive wheel is located on a third leg.

In this known design, the integral manufacture of the leg and toothed segment is expensive. Furthermore it is inconvenient to have the toothed segments extending too far on either side when the compass is closed or only slightly open — it makes it difficult to place the compass in a case or box, and to handle the compass, particularly when adjusting to a small radius. In addition, the third leg carrying the drive-wheel represents additional materials and labour expenditure. Finally the distance between the two toothed segments and the rotation point tends to differ; this results in shortcomings during handling, viz. unequal opening opening of the two outer legs.

SUMMARY OF THE INVENTION

The purpose of the invention is to provide a compass with fine adjustment means, requiring less design and production expenditure than the known compass, and which is free from laterally-projecting components. Starting from the design as previously described, the purpose is achieved according to the invention, in that the spreaders and the drive-wheel are located within the compass-head. From the design viewpoint the solution is particularly attractive. By insetting the spreaders within the compass head, they do not need to be inordinately long to achieve a sufficient spread angle, and they can be considerably shorter than the spreaders of the known compass, so that any lateral projection is effectively avoided; the maximum spread angle is consequently no smaller than for the known compass.

Conveniently, the spreaders take the form of straight members. In this manner any handling difficulties arising with the known type of compass and resulting from the differing curvature of the toothed segments are suitably avoided.

In a first design according to the invention, the members are set in recesses within the compass legs, passing through the legs in the spread direction. Nevertheless a second typical design according to the invention is mechanically simpler, the members being located on the front- and/or rear- face(s) of the compass legs; guides for the members can then be provided on the inner face of compass-head half-shells. As the compass-head half-shells are invariably plastic injection-mouldings, the necessary recesses for the drive, i.e. including the guides for the members, can be simply provided by suitable design of the injection moulding die, without the need for special machining.

In order to achieve the simplest possible actuation of the fine-adjustment of the compass, a rotary adjuster component is preferably located in each half-shell of the compass-head; the two facing components being arranged coaxially and being connected in a torsion-proof manner by the shaft of the drive-wheel.

According to a further favorable feature of the invention, a groove guiding the compass-head articulation is provided on the inside of the two compass-head half-shells, extending in the direction of the compass longitudinal axis.

Figure 1:
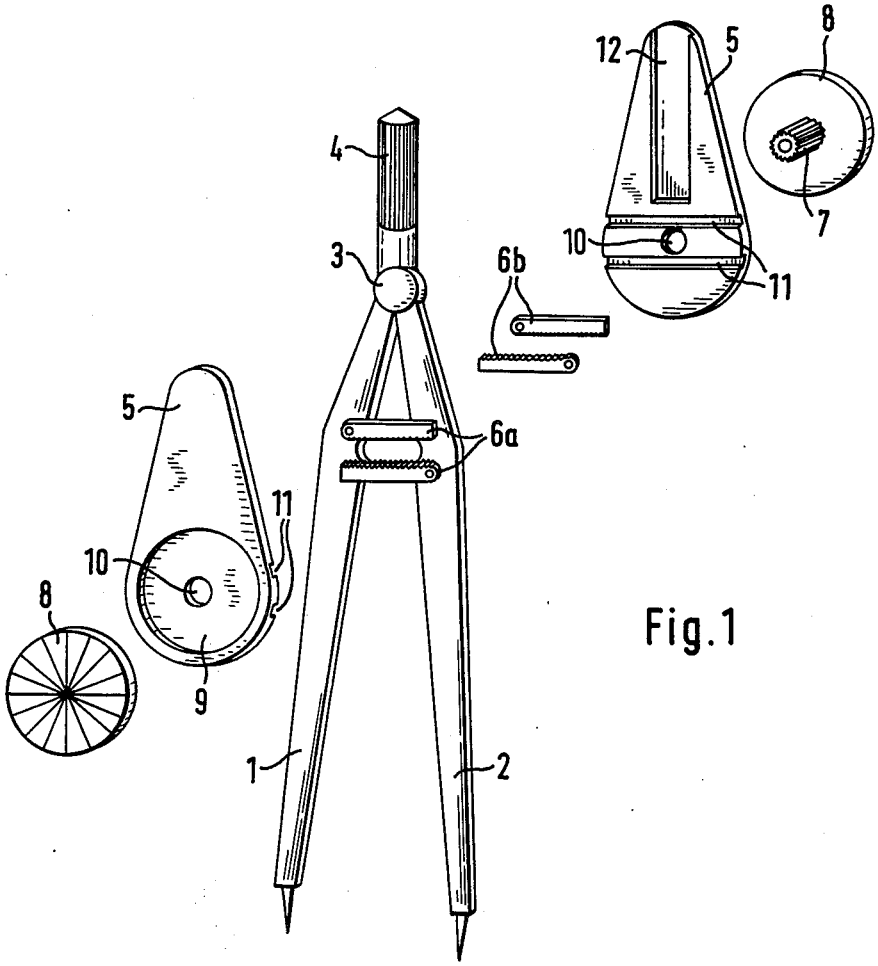
FIG. 1 is an exploded view of a compass with compass head.
Figure 3:
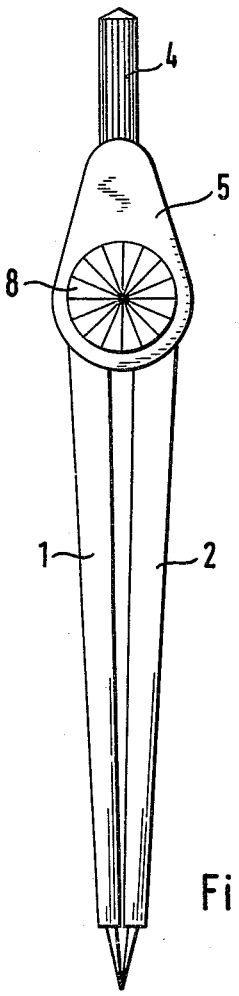
FIG. 3 is a view of an assembled compass.

The compass of FIG. 1 has two legs 1 and 2, pivoting from an articulation axle 3, and extending upwards into a knurled holding lug 4. Half-shells are shown in 5. The upper part of the legs 1 and 2, the articulation axle 3, the holding lug 4 and the two half-shells 5 form a compass-head.

Pairs of toothed members *6a* and *6b* are located on the front- and rear- faces of the legs 1 and 2 in the area of the compass-head. These parallel toothed members *6a* and *6b* extend in the plane of the compass transversely to the compass longitudinal axis, the two upper toothed members and being secured to leg 1, and the two lower toothed members being secured to leg 2, in the example shown in the illustration.

A gear-wheel 7 meshes with the toothed members *6a* and *6b*, and is held between two disc-like coaxially arranged adjuster components 8, forming a torsion-proof connection; the gear-wheel is nevertheless only actuated by means of one adjuster component 8, so that it only needs to be secured in a torsion-proof manner with a single adjuster-component 8. The adjuster components 8 are rotatably mounted in recesses 9 within the compass-head half-shells 5; the recesses 9 have a central bore 10 for the gear-wheel 7.

Two parallel guides 11 extending transversely to the compass longitudinal axis are provided on the inside of each compass-head half-shell 5, for guiding the toothed members *6a* and *6b*, and a groove 12 formed in the direction of the compass longitudinal axis serves as a guide for the compass-head articulation axle 3.

In the example of the invention as shown the drive consists of toothed members and a gear-wheel. Instead of this arrangement as shown, it is naturally also possible to use a knurled member with a knurled wheel, viz. a drive consisting of a pressure member and a pressure wheel preferably made of hard rubber.

Figure 2:
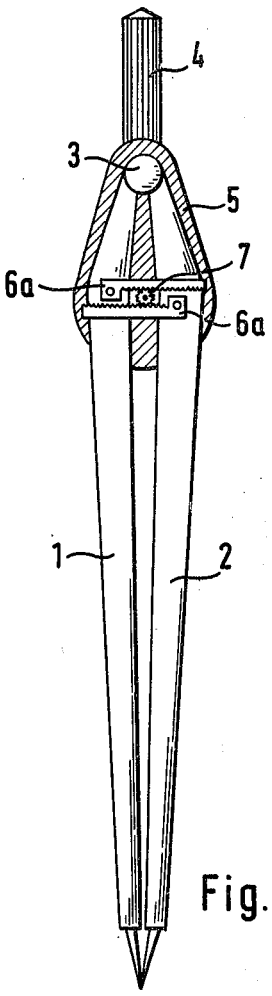
FIG. 2 is a view of a compass with a front compass-head half-shell removed.
Figure 4:
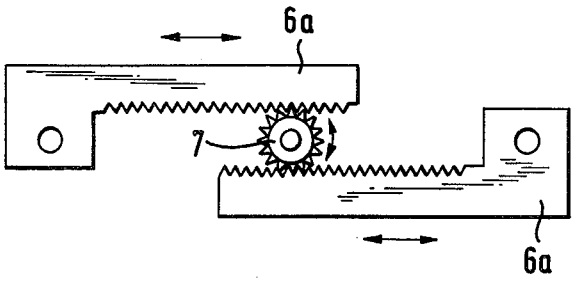
FIG. 4 is a detailed view of a gear-wheel drive.

FIGS. 2 and 4 show somewhat modified toothed members *6a* and *6b*.

I claim:

1. A compass comprising a pair of compass legs pivoted about an articulation axle and fine adjustment means comprising a pair of linear spreaders pivoted to the respective compass legs in spaced relation lengthwise of the legs, each spreader extending from its pivotal connection with the respective leg towards the other leg, a drive wheel between the spreaders and between the compass legs for moving the spreaders in mutually opposed directions on rotation of the drive wheel by contact of the drive wheel periphery with driving surfaces of the respective spreaders, the drive wheel having an axis perpendicular to the plane of the compass, support means for the drive wheel comprising front and rear half-shells defining a compass head, guide means for maintaining the spreaders in parallelism and in driving contact with the drive wheel periphery during opening and closing of the compass and an operating disk coaxial with said drive wheel and in direct driving connection therewith for rotating said drive wheel to operate the spreaders, said operating disk being located on an outer surface of one of said half-shells.

2. The compass of claim 1, wherein said spreaders are pivoted to outer surfaces of the respective compass legs and said guide means is formed on an inner surface of one of said half-shells.

3. The compass of claim 1, including first and second pairs of spreaders pivoted to front and rear surfaces of the respective compass legs and wherein, said guide means is formed on inner surfaces of the respective half-shells.

4. The compass of claim 1, wherein said drive wheel is a gear wheel meshing with gear teeth formed on said driving surfaces of the respective spreaders.

* * * * *